US008057115B2

(12) United States Patent
Scofield et al.

(10) Patent No.: US 8,057,115 B2
(45) Date of Patent: Nov. 15, 2011

(54) MEDIA CARRIER

(75) Inventors: Stuart A. Scofield, Battleground, WA (US); Jeffrey G. Castleberry, Underwood, WA (US); Steven H. Walker, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1188 days.

(21) Appl. No.: 11/494,957

(22) Filed: Jul. 28, 2006

(65) Prior Publication Data

US 2008/0024579 A1 Jan. 31, 2008

(51) Int. Cl.
*B41J 33/00* (2006.01)

(52) U.S. Cl. ..... 400/48; 101/37

(58) Field of Classification Search ..... 101/35, 101/41, 42, 43, 44; 400/48; 720/606
See application file for complete search history.

(56) References Cited

U.S. PATENT DOCUMENTS 5,208,633 A * 5/1993 Genovese ..... 399/162
5,504,729 A * 4/1996 Ikedo et al. ..... 720/614
5,543,001 A 8/1996 Casillo et al.
5,984,619 A * 11/1999 Allen et al. ..... 414/752.1
6,069,858 A * 5/2000 Endo et al. ..... 720/627
6,134,205 A * 10/2000 Watanabe ..... 720/606
6,148,722 A * 11/2000 Hagstrom ..... 101/35
6,270,176 B1 8/2001 Kahle
6,332,680 B1 12/2001 Ozawa
6,480,442 B1 11/2002 Nakatani et al.
6,501,718 B1 * 12/2002 Ono et al. ..... 369/53.2
6,580,444 B1 * 6/2003 Drynkin et al. ..... 347/171
6,869,235 B2 * 3/2005 Kawaguchi et al. ..... 400/59
6,893,176 B2 * 5/2005 Obara ..... 400/693
6,899,474 B2 5/2005 Uchida et al.
6,945,714 B2 9/2005 Miyauchi et al.
6,953,246 B2 10/2005 Takahashi et al.
7,101,096 B2 * 9/2006 Sasai et al. ..... 400/48
7,191,455 B2 * 3/2007 Murata et al. ..... 720/626
2003/0218967 A1 * 11/2003 Hsu et al. ..... 369/280
2004/0228108 A1 * 11/2004 Lee et al. ..... 362/31
2006/0031859 A1 2/2006 Matsuda et al.

* cited by examiner

*Primary Examiner* — Ren Yan
*Assistant Examiner* — David Banh

(57) ABSTRACT

A system having a disc carrier determines a location of the disc carrier based upon first and second specular signals from an optical sensing element, the first specular signal occurring when the incident light is not received within the opening and impinges a first portion of the optical sensing element and the second specular signal occurring when the incident light is received within the opening and impinges a second portion of the optical sensing element.

19 Claims, 6 Drawing Sheets

MEDIA CARRIER

BACKGROUND

Media carriers are used to hold and retain discs as the discs are moved through a printer or other disc interacting device. Identifying the positioning of the carrier and the carried disc is difficult and subject to error, potentially leading to printing or other interaction errors.

DETAILED DESCRIPTION OF THE EXAMPLE EMBODIMENTS

Figure 1:
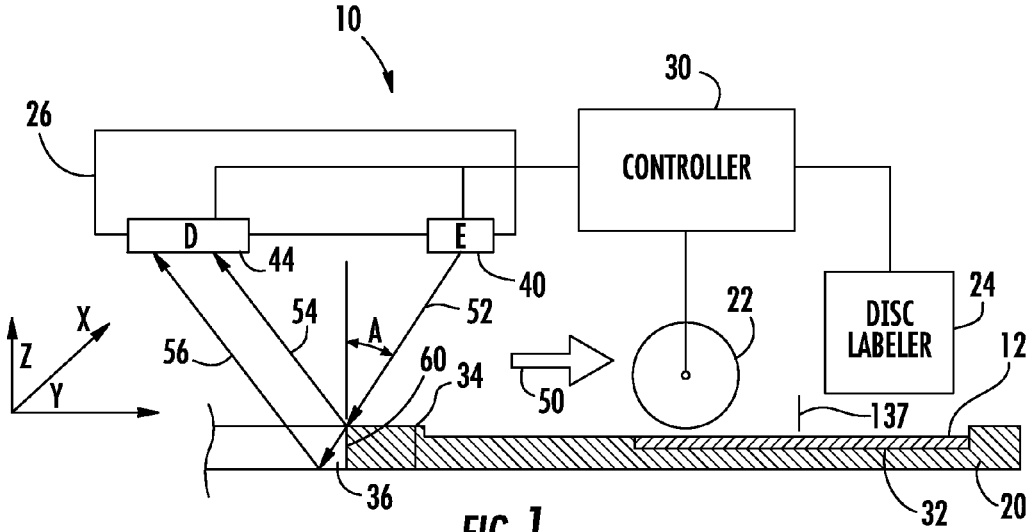
FIG. 1 is a schematic illustration of a media interaction system with portions shown in section according to an example embodiment.

FIG. 1 schematically illustrates media interaction system 10 according to an example embodiment. In the particular embodiment illustrated, media interaction system 10 is configured to apply a label to a rigid medium, such as a disc 12. In the example embodiment illustrated, media interaction system 10 comprises a disc printing system configured to print a label on disc 12. In yet other embodiments, system 10 may alternatively be configured to interact with disc 12 in other fashions. In still other embodiments, system 10 may be configured to print upon or otherwise interact with media other than discs such as non-circular or non-annular rigid media carried by a carrier.

Media interaction system 10 includes media carrier 20, carrier transport 22, disc labeler 24, sensor 26 and controller 30. Media carrier 20 comprises one or more structures configured to carry disc 12 past disc labeler 24. Media carrier 20 includes disc retaining portion 32, position detection or fiducial surface 34 and recess 36. Disc retaining portion 32 comprises a structure configured to hold and/or guide the positioning of disc 12 with respect to carrier 20. In the embodiment illustrated, retaining portion 32 comprises a circular or annular depression or footprint formed within the body of carrier 20, wherein the footprint receives disc 12. In other embodiments, retaining portion 32 may have other configurations. For example, in other embodiments, retaining portion 32 may alternatively comprise a spoke, hub or projection configured to pass through a central opening in disc 12. Retaining portion 32 has a predetermined location or offset position with respect to a junction of fiducial surface 34 and recess 36.

Fiducial surface 34 and recess 36 cooperate to facilitate the detection and determination of the positioning of carrier 20 and disc 12 by sensor 26. Fiducial surface 34 comprises a surface elevated or extending above recess 36 and configured to at least partially reflect electromagnetic radiation, such as light, emitted by sensor 26. Recess 36 comprises a void extending below fiducial surface 34 adjacent to fiducial surface 34. Recess 36 and surface 34 are separated by a transition edge 60 extending non-parallel and nominally perpendicular to the direction in which carrier 120 is moved as indicated by arrow 50.

In one embodiment, recess 36 comprises an opening or hole completely passing through carrier 20. In yet other in embodiments, recess 36 comprises a depression partially extending into the body of carrier 20, but not completely passing through carrier 20. As described in greater detail hereafter, recess 36 causes light being reflected either by an underlying surface (as when recess 36 comprises a hole extending through carrier 20) or a floor of recess 36 (as when recess 36 does not extend completely through carrier 20) to impinge a detection component of sensor 26 at a different location or not at all as compared to light reflected from fiducial surface 34. The different location at which reflected light impinges sensor 26 is used by system 10 to identify the position of edge 60 which in turn is used to determine the positioning of carrier 20 and disc 12.

Carrier transport 22 comprises one or more mechanisms configured to engage carrier and to move carrier 20 relative to disc labeler 24 and sensor 26. In one embodiment, carrier transport 22 comprises one or more rotationally driven rollers in engagement with carrier 20. In other embodiments, carrier transport 22 may comprise one or more belts, conveyors or other mechanisms configured to move carrier 20. In still other embodiments, carrier transport 22 may be omitted where disc labeler 24 and sensor 26 are alternatively moved with respect to carrier 20.

Disc labeler 24 comprises a device configured to apply a label or other markings to disc 12. In one embodiment, disc labeler 24 comprises one or more print heads configured to eject fluid, such as ink, on to disc 12. In one embodiment, such print heads may be movable with respect to carrier 20. In other embodiments, such print heads may be stationery. For example, such print heads may alternatively be part of a page-wide-array print head. In other embodiments, disc labeler 24 may be configured to alter the surface of disc 12 in other fashions. For example, in other embodiments, disc labeler 24 may alternatively be configured to adhere a label on to disc 12 or may be configured to write or mark disc 12 using electromagnetic radiation, such as with a laser.

Sensor 26 comprises the device configured to sense positioning of carrier 20 based upon electromagnetic radiation, such as light, reflected from carrier 20. In the example embodiment illustrated, sensor 26 includes emitter 40 and detector 44. The emitter 40 comprises a device configured to emit electromagnetic radiation towards fiducial surface 34 and/or towards recess 36 depending upon the position of carrier 20. In the example illustrated, emitter 40 is configured to emit visible light. In one embodiment, emitter 40 is configured to emit blue light having a wavelength of approximately 428 nm or red light having a wavelength of approximately 640 nm. In one embodiment, emitter 40 may comprise one or more light emitting diodes. In other embodiments, emitter 40 may be configured to emit other wavelengths of visible light or other forms of electromagnetic radiation such as infrared light or ultraviolet light.

Emitter 40 is configured to emit light at a nonzero angle A with respect to a line perpendicular to fiducial surface 34 of carrier 20. In one embodiment, emitter 40 emits light at an angle A of approximately 34°. In other embodiments, emitter 40 may emit such light at a different angle A.

Detector 44 comprises a device configured to receive and sense electromagnetic radiation emitted by emitter 40 and reflected from carrier 20 or a surface underlying carrier 20. In one embodiment, detector 44 is configured to sense reflected visible light. In response to being impinged by reflected light or other reflected electromagnetic radiation, detector 44 generates signals which are transmitted to controller 30 (such as through an analog to digital converter) and used by controller 30 to determine positioning of edge 60 and carrier 20.

Controller 30 comprises one or more processing units configured to analyze signals received from detector 44 and to determine positioning of carrier 20 based upon such signals. Controller 30 is further configured to generate control signals based at least in part upon the determine position of carrier 20, wherein carrier transport 22 moves carrier 20 in response to such control signals and wherein disc labeler 24 applies one or more labels to disc 12 in response to such control signals. For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. Controller 30 is not limited to any specific combination of hardware circuitry and software, nor to any particular source for the instructions executed by the processing unit.

In operation, disc 12 is removably secured to retaining portion 32 of carrier 20. In one embodiment, disc 12 is positioned within the footprint of retaining portion 32 of carrier 20. Media carrier 20 is subsequently positioned in proximity to carrier transport 22. In response to receiving a labeling command from a user via a keyboard, mouse or other input device (not shown), controller 30 generates control signals directing carrier transport 22 to move carrier 20 towards and opposite to sensor 26 in the direction indicated by arrow 50. Controller 30 further generates control signals directing emitter 40 to emit visible incident light towards carrier 20 as schematically represented by arrow 52. Arrow 52 schematically represents a center of a wider beam of such visible incident light emitted by emitter 40.

As indicated by arrow 54, light reflected from fiducial surface 34 is reflected at a complementary angle (i.e., an angle equal and opposite angle) to the angle at which light impinges fiducial surface 34. Because incident light impinging fiducial surface 34 is at an angle A from perpendicular to fiducial surface 34, reflected light 54 is also at an angle A with respect to a line perpendicular to fiducial surface 34. As also schematically illustrated by arrow 56, light passing into recess 36 and reflected from either a floor of recess 36 or a surface underlying carrier 20 is also reflected at a complementary angle to the angle at which light impinges the reflecting surface below recess 36. Because light impinging the surface below recess 36 is at an angle A from a line perpendicular to the reflecting surface below recess 36, reflected light 56 is also at the same angle A with respect to a line perpendicular to the surface below recess 36. However, because impinging light 52 travels across the additional depth of recess 36, reflected light 56 is offset further from emitter 40 as compared to light reflected from surface 34. As a result, reflected light 56 impinges sensor 26 at a location different than the location at which reflected light 54 impinges sensor 26. In the particular example illustrated, detector 44 is positioned with respect to emitter 40 such that a greater percentage of reflected light 54 reflected from fiducial surface 34 impinges detector 44 as compared to reflected light 56 reflected from the one or more surfaces below recess 36. This difference in the amount of light impinging detector 44 causes detector 44 to produce different signals: a first range of signals when light is being reflected from fiducial surface 34 and a second range of signals when light is being reflected from one or more surfaces below recess 36.

Figure 2:
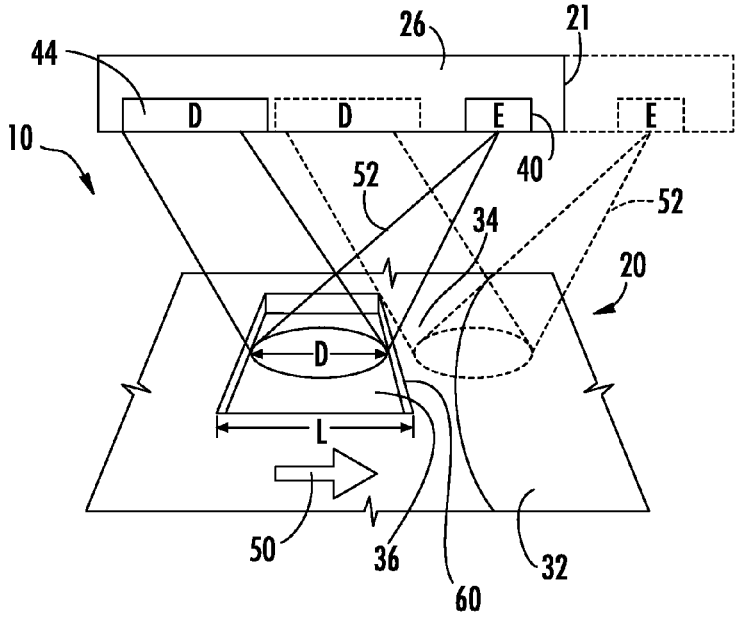
FIG. 2 is a fragmentary top plan view schematically illustrating another embodiment of a sensor of the disc interaction system of FIG. 1 according to an example embodiment.

FIG. 2 illustrates emitted light 52 in more detail. As shown by FIG. 2, as carrier 20 is moved by carrier transport 22 in the direction indicated by arrow 50, a spot of light 52 emitted by emitter 40 impinges and is reflected from fiducial surface 34 and subsequently passes through recess 36 and is reflected from a surface below recess 36. Because carrier 20 is being moved in the direction indicated by arrow 50, emitted light 52 appears as an ovular spot having a longer diameter or dimension in the direction of arrow 50.

In one embodiment, recess 36 has a length L at least as long as and nominally greater than the maximum dimension D of the oval spot of emitted light 52. In particular, recess 36 has a dimension D at least as large as the corresponding Y-axis dimension of a field of view (FOV) of detector 44. As a result, the entire spot of light sensed by detector 44 is received within recess 36, producing a larger difference or margin in the intensity of light sensed by detector 44 between the time when the spot is being reflected from surface 34 and the time when the spot is being reflected from below recess 36. Consequently, controller 30 may be better able to identify the transitioning from the first signal to the second signal as the spot of the emitted light 52 moves across edge 60. In other embodiments, recess 36 may have other dimensions or configurations.

Controller 30 receives and analyzes such signals to determine positioning of carrier 20. In particular, controller 30 identifies when signals from detector 44 of sensor 26 transition from the first signal to the second signal. This transition occurs when edge 60 between fiducial surface 34 and recess 36 of carrier 20 moves across a spot of impinging light 52 from emitter 40. Based upon the speed at which carrier transport 22 is moving carrier 20, the angle A at which emitter 40 is emitting impinging light 52 and the time at which controller 30 identifies the transition from the first signal to the second signal from detector 44 of sensor 26, controller 30 (using an algorithm or other method) determines positioning of carrier 20. Based on this determined position of carrier 20, controller 30 generates control signals directing further movement of carrier 20 and operation of disc labeler 24 to apply a label to disc 12.

Because controller 30 determines the positioning of carrier 20 and disc 12 utilizing signals from detector 44, capturing specular reflection, which provides a larger signal margin as compared to signals from diffuse reflection, controller 30 may more reliably locate carrier 20 over time despite a reduction in the reflectivity of fiducial surface 34 caused by scratches or other degradation of fiducial surface 34. Consequently, the useful life of carrier 20 may be lengthened and the reliability of system 10 is enhanced.

Figure 3:
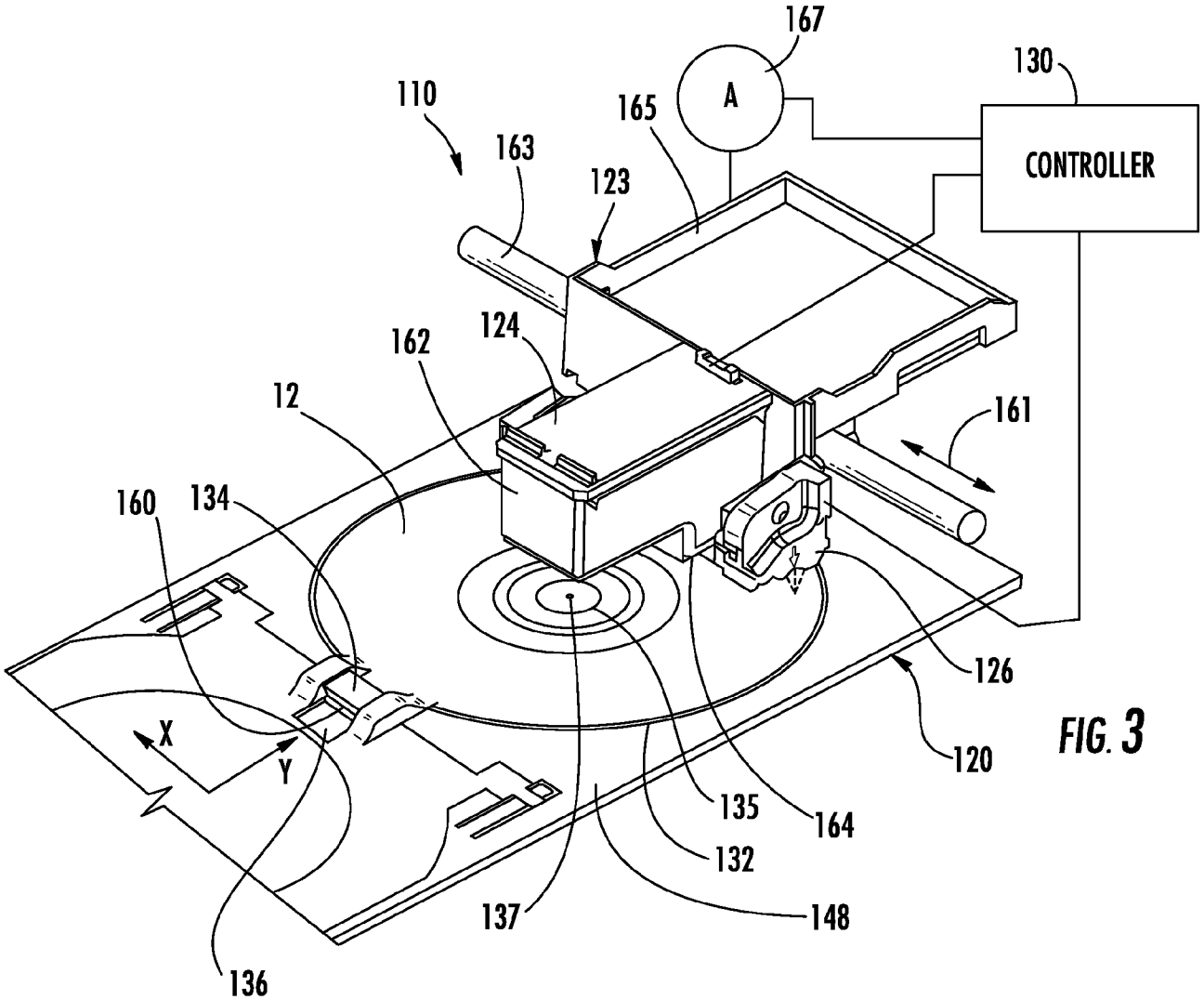
FIG. 3 is a top perspective view schematically illustrating another embodiment of the media interaction system of FIG. 1 according to an example embodiment.
Figure 4:
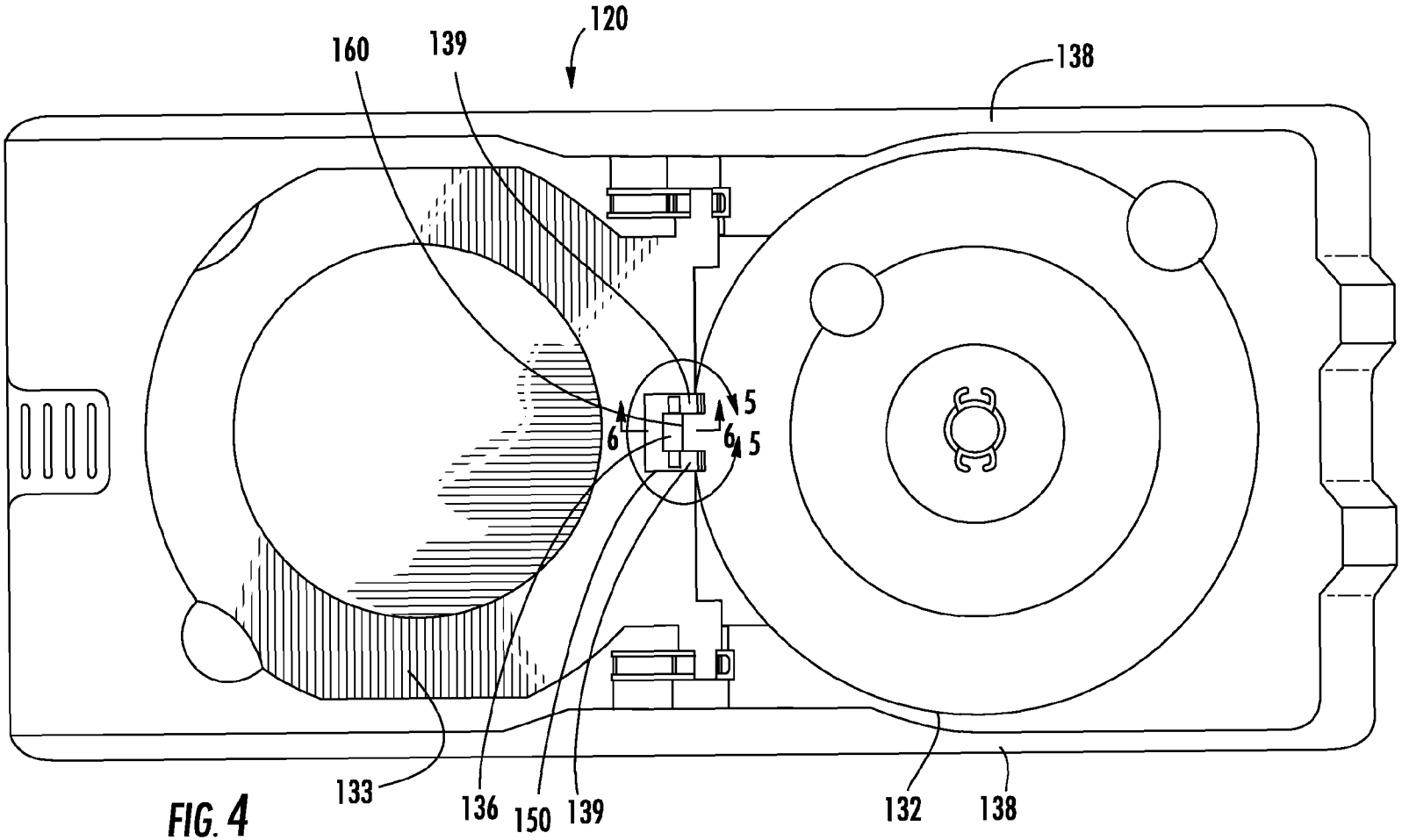
FIG. 4 is a top plan view of one example of a media carrier of the media interaction system of FIG. 3 according to an example embodiment.
Figure 5:
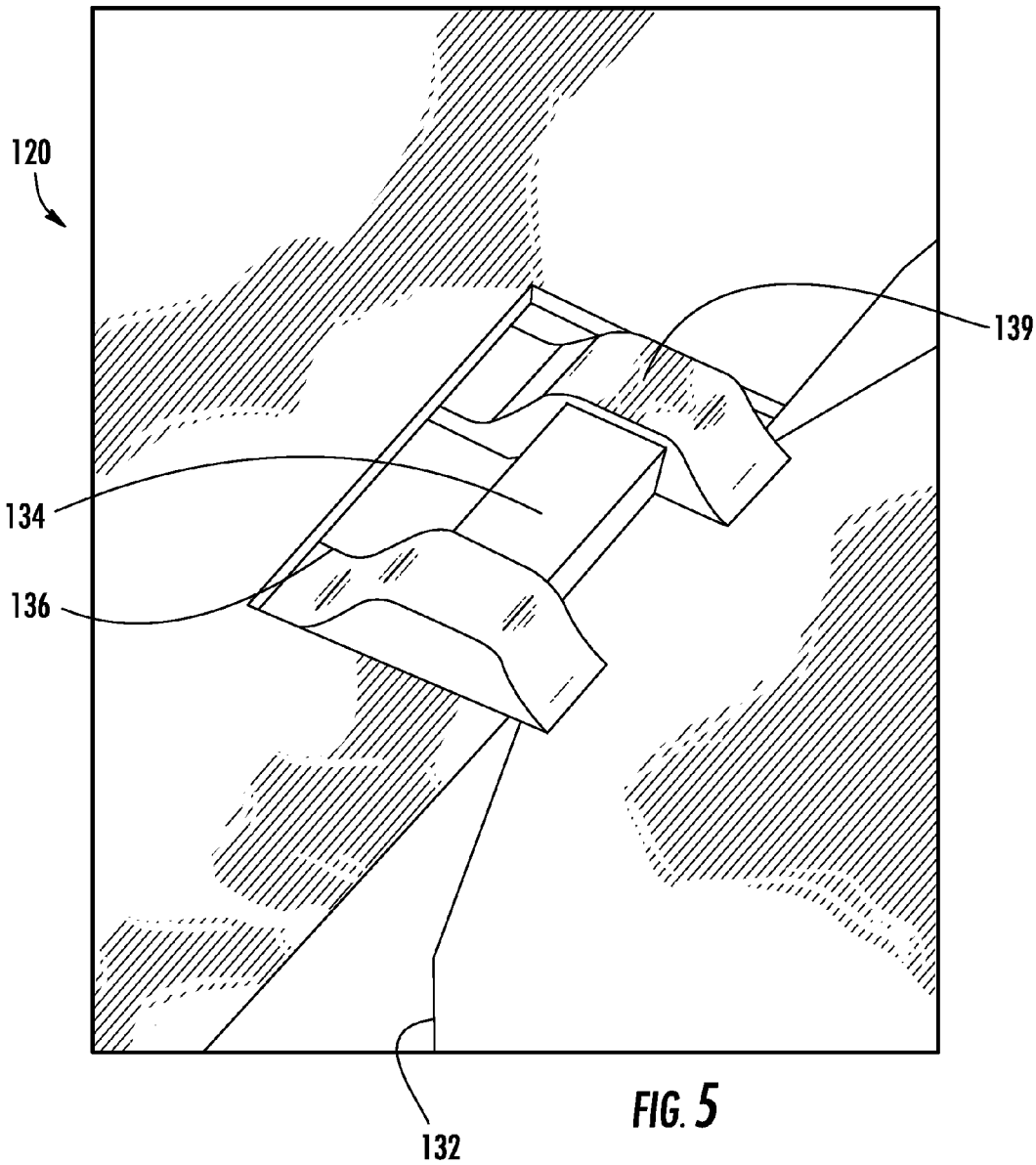
FIG. 5 is an enlarged fragmentary top perspective view of the media carrier of FIG. 4 taken along line 5-5 according to an example embodiment.
Figure 6:
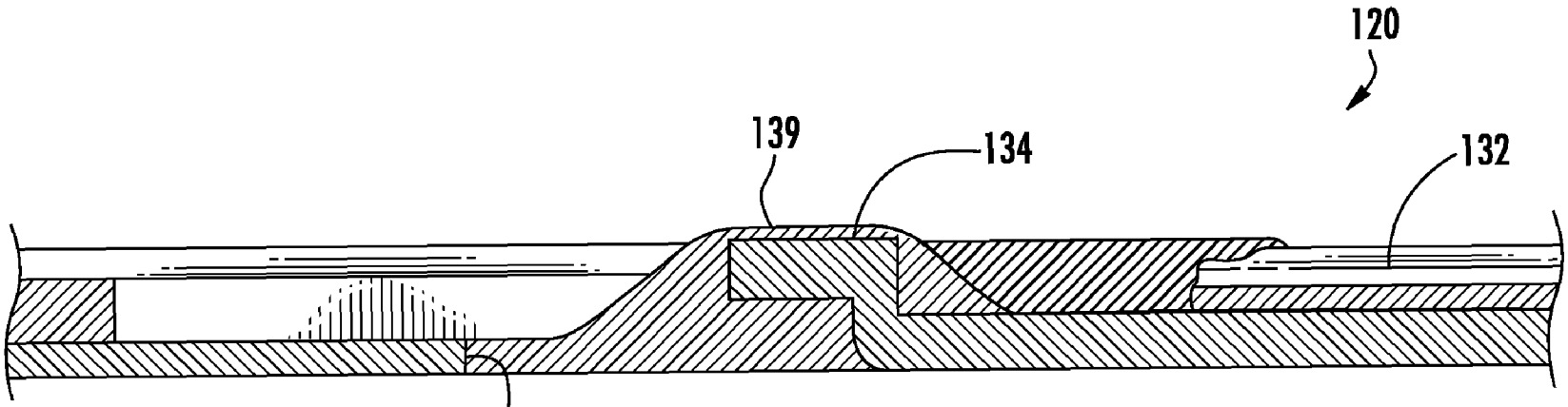
FIG. 6 is a sectional view of the media carrier of FIG. 4 taken along line 6-6 according to an example embodiment.

FIG. 3 illustrates media interaction system 110, another embodiment of media interaction system 10. Media interaction system 110 includes media carrier 120, carrier transport 22 (shown and described with respect to FIG. 2), carriage mechanism 123, disc labeler 124, sensor 126 and controller 130. FIGS. 4-6 illustrate carrier 120 in more detail. Media carrier 120 is similar to media carrier 20 in that media carrier 120 is configured to carry and maintain positioning of disc 12 during interaction with disc 12. Media carrier 120 generally includes retaining portion 132, template 133 (shown in FIG. 4), Y-axis fiducial surface 134, hub 135, recess 136, X-axis fiducial surfaces 138, and ramps 139. Retaining portion 132 comprises a circular depression or footprint formed in body 148 of carrier 120. The footprint of retaining portion 132 is configured to receive disc 12 and has a diameter slightly larger than an outer diameter of disc 12 such that disc 12 when received within retaining portion 132 has reduced movement within the footprint of retaining portion 132. Retaining portion 132 cooperates with hub 135 to secure a disc 12 in place on carrier 120. In the embodiment illustrated, hub 135, which comprises a hub, spoke, resilient tabs and the like configured to project through a central opening of disc 12 and to engage disc 12, determines the position of disc 12 on carrier 120. In other embodiments, this position may alternatively be defined by retaining portion 132.

Template 133 comprises a structure configured to facilitate retention of smaller sized discs by carrier 120. In the particular example illustrated, template 133 comprises an annular ring having an outer diameter substantially the same size as the outer diameter of a first disc and having an inner diameter substantially the same size as a second smaller disc to be carried by carrier 120. In one embodiment, the footprint of retaining portion 132 has an inner diameter of slightly larger than about 120 mm. Template 133 had an outer diameter of about 120 mm and an inner diameter of slightly larger than 80 mm. With template 133, carrier 120 is able to carry discs having diameters of 80 mm or 120 mm. In other embodiments, retaining portion 132 and template 133 may have other dimensions.

In the particular example illustrated, template 133 is movably coupled to carrier 120 to move between a withdrawn position in which template 133 is not within the footprint of retaining portion 132 and an in-use position in which template 133 is located within the footprint of retaining portion 132. In the particular example illustrated, template 133 is pivotably coupled to body 148 (shown in FIG. 3) of carrier 120 so as to pivot between the withdrawn position and the in-use position. As shown by FIG. 4, template 133 includes an opening or cut out 150 so as to not obstruct or interfere with use recess 136 in determining a position of carrier 120. In other embodiments, template 133 may be removable or separable from carrier 120 or may be omitted.

Y-axis fiducial surface 134 and recess 136 are substantially similar to surface 34 and recess 36 of media carrier 20. Fiducial surface 134 comprises a surface extending above recess 136 and configured to reflect light, such as visible light, from sensor 126. In the particular example illustrated, fiducial surface 134 projects above a remainder of body 148 and is polished so as to have an enhanced reflectivity. Fiducial surface 134 has an edge 160 adjacent to recess 136 which has a predetermined spatial relationship with respect to retaining portion 132. For example, edge 160 is spaced from an axial center 137 of retaining portion 132 by a predetermined distance in the Y-axis direction and is spaced from retaining portion 132 along a line intersecting center 137 by a predetermined distance in the Y-axis direction. In a particular example illustrated, surface 134 is integrally formed as part of a single unitary body with body 148 and retaining portion 132. In one embodiment, surface 134 is integrally molded as single unitary body with carrier body 148. As a result, media carrier 120 is less complex and may be manufactured at a lower cost. In other embodiments, surface 134 may be welded, bonded, or fastened to body 148 of carrier 120.

Recess 136 comprises an aperture extending through body 148 adjacent to edge 160 of fiducial surface 134. Like recess 36, recess 136 has a sufficient depth from fiducial surface 134 such that the intensity of light reflected by surface 134 and detected by sensor 126 is largely different than the intensity of light reflecting from the surface underlying recess 136 being detected by sensor 126. The abrupt change in the intensity of reflected light enables controller 130 to better identify edge 160 and therefore determine the position of carrier 120.

Although recess 136 is illustrated as completely extending through body 148, facilitating manufacture of carrier 120, in other embodiments, recess 136 may comprise a depression or cavity partially extending into body 148. Although fiducial surface 134 and recess 136 are illustrated as being in alignment with center 137, in other embodiments, fiducial surface 134 and recess 136 may be provided at other locations on carrier 120. Although fiducial surface 134 is illustrated as being located between recess 136 and center 137 of disc 12, in other embodiments, recess 136 may alternatively be located between surface 134 and center 137.

X-axis fiducial surfaces 138 comprise reflective surfaces along an outer perimeter of a top surface of carrier 120. In the particular example illustrated, fiducial surfaces 138 comprises a polymeric material molded so as to be glossy and reflect light. Fiducial surfaces 138 facilitate detection of the position of carrier 120 along the x-axis by sensor 126 and controller 130. In other embodiments, other structures and methods may alternatively be used to detect the position of carrier 120 along the X-axis.

Ramps 139 comprise raised structures coupled to body 148 which are configured to inhibit or reduce contact with fiducial surface 134. As a result, degradation of the reflectivity of surface 134 over time due to contact is also reduced. In the particular embodiment illustrated, ramps 139 extend on opposite sides of surface 134 and are configured to elevate any structure that may potentially contact surface 134 above surface 134. For example, when carrier 120 and the associated disc 12 are being moved into or through an interaction device, such as a printer, the top surface of carrier 120 may be contacted by various structures such as rollers and the like. Such rollers may otherwise scratch, abraid or otherwise degrade surface 134. Ramps 139 elevate such rollers or structures above surface 134 to protect the reflectivity of surface 134 and to prolong the useful life of carrier 120.

As shown by FIG. 3, carriage mechanism 123 comprises an arrangement of components configured to scan or move labeler 124 and sensor 126 across carrier 120 and disc 12 in the direction indicated by arrows 161. Carriage mechanism 123 includes carriage rod 163, carriage 165 and actuator 167. Carriage rod 163 extends along the x-axis and is configured guide movement of carriage 165. Carriage 165 comprises one more structures movably supported along carriage rod 163 and configured to support labeler 124 and sensor 126. Actuator 167 comprises a device configured to move carriage 165 along carriage rod 163. In one embodiment, actuator 167 comprises a motor operably connected to carriage 165 by a series of gears or pulleys and a belt or chain so as to linearly move carriage 165 along rod 163. In other embodiments, other linear actuation mechanisms may be used to move carriage 165 along rod 163. In still other embodiments, carriage mechanism 123 may be omitted where labeler 124 extends across a width of disc 12.

Disc labeler 124 comprises a device configured to print a label upon disc 12. In the particular example illustrated, disc labeler 124 comprises a print cartridge having an ink reservoir 162 and an inkjet print head 164. Ink reservoir 162 contains and supplies fluid, such as ink, to print head 164 which selectively ejects such ink onto disc 12 in response to control signals from controller 130. In other embodiments, labeler 124 may alternatively comprise an ink jet print head having an off-axis supply of fluid or ink. Although labeler 124 is illustrated as being configured to be scanned across carrier 120 and across disc 12 during such printing by carriage mechanism 123, in other embodiments, labeler 124 may alternatively include a page-wide-array of print heads. In yet other embodiments, labeler 124 may be configured to apply an image or a label to disc 12 in other fashions. In one embodiment, disk labeler 124 is part of a printer configured to additionally print upon sheets of planar print media, such as cellulose media (paper). In other embodiments, labeler 124 may be incorporated as part of a mechanism dedicated to printing upon or otherwise labeling discs.

Figure 7:
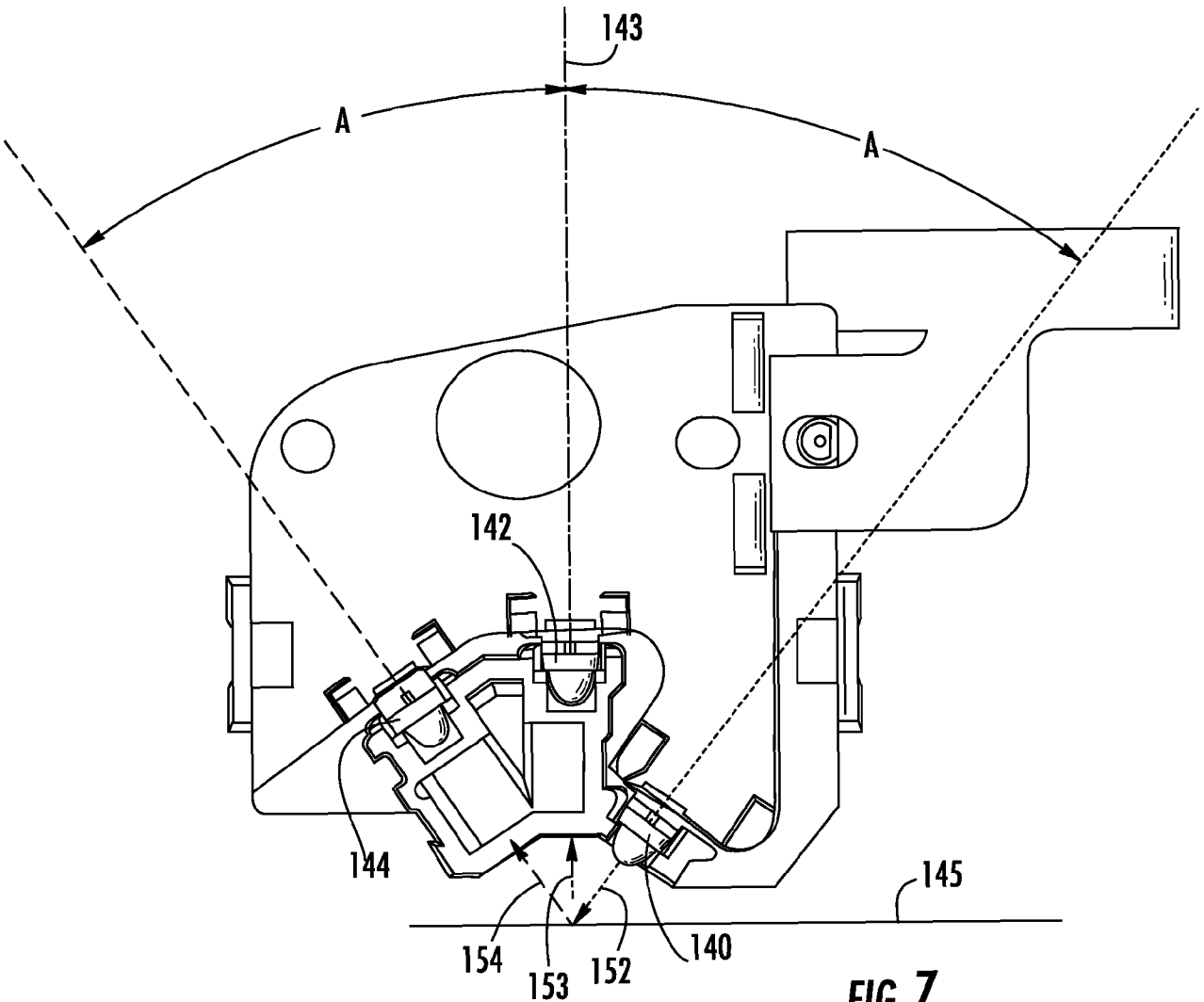
FIG. 7 is a sectional view of one example of a sensor of the media interaction system of FIG. 3 according to an example embodiment.

Sensor 126 comprises a sensing device configured to facilitate optical detection of a position of carrier 120 and disc 12. In the particular example illustrated, sensor 126 is further configured to optically detect characteristics of media being printed upon. FIG. 7 is a sectional view illustrating sensor 26 in more detail. As shown by FIG. 4, sensor 126 includes emitter 140, and detectors 142 and 144. Emitter 140 comprises a source of visible incident light 152 extending at an angle A with respect to a line 143 extending perpendicular to horizontal or surface 145 of media to be printed upon. In a bigger example illustrated, emitter 140 is oriented at an angle of −34° from line 143. In the particular example illustrated, emitter 140 comprises a light emitting diodes configured to emit blue light or red light. In other embodiments, emitter 140 may be oriented at other angles, may comprise other light sources and may be configured to emit other wavelengths of visible light or other wavelengths of other light such as ultraviolet light or infrared light.

Detector 142 comprises an optical sensor figured to receive and produce output signals based upon reflected diffuse light 153 impinging detector 142. Detector 142 is oriented orthogonal to surface 145 and provides a diffuse channel for detecting ink and edges of media. In one particular embodiment of, detector 142 comprises a phototransistor and has a field of vision of approximately 1.1×1.7 mm. In other embodiments, detector 142 may comprise other sensing devices and may have other field of vision characteristics.

Detector 144 comprises an optical sensor configured to receive and produce output signals based upon reflected specular light 154 impinging detector 144. Detector 144 is oriented at an angle complementary to angle A. In other words, detector 144 is oriented to receive light at an angle equal to an opposite to the angle at which light emitted from emitter 140 is oriented. In the particular example illustrated, detector 144 is oriented at +34° from line 143. In the example illustrated, detector 144 has an elongated aperture along in the Y-axis and has a field of vision of approximately 1.3×1.8 mm. in the example illustrated, detector 144 comprises a phototransistor. In other embodiments, detector 144 may comprise other optical sensing devices having other characteristics.

Controller 130 comprises one or more processing units configured to analyze signals received from detector 144 and to determine positioning of carrier 120 based upon such signals. In particular, controller 130 determines an X-axis position of carrier 120 by generating control signals directing carriage mechanism 123 to move sensor 126 along the X-axis and across the edge of carrier 120 across X-axis fiducial surface 138 to identify the edge of carrier 120 and the X-axis positioning of carrier 120 based upon change in signal levels or signal margin received from detector 144. In one embodiment, controller determines the location of carrier 120 by sensing the transition from light incident off carrier 120 (little or no reflection) to light incident upon and reflected from surface 138 (a larger specular reflective signal level).

Controller 130 further determines positioning of carrier 120 and disc 12 along the Y-axis in a fashion substantially similar to that described with respect to the determination of the positioning of carrier 20 in FIG. 1. In particular, controller 130 acquires specular data (nominally every $600^{th}$ of an inch) and determines the location of edge 160 by identifying the transition in signal level from light reflected through recess 136 (a low signal) to light reflected off surface 34 (a high signal). In other embodiments, detector 144 may be otherwise positioned such that a low signal is received from light reflected from surface 134 and a high signal is received from light reflected through recess 136. Because controller 130 determines the positioning of carrier 120 and disc 12 utilizing signals from detector 144, the specular channel, which provides a larger signal margin as compared to signals from detector 142, the diffuse channel, when used with fiducial surface 34, controller 130 may more reliably locate carrier 120 over time despite a reduction in the reflectivity of fiducial surface 34 caused by scratches or other degradation of fiducial surface 34. Consequently, the useful life of carrier 120 maybe lengthened.

Because fiducial surface 34 is integrally formed as part of a single unitary body with body 148 of carrier 120, secondary operations during the manufacture of carrier 120 may be and reduced, lowering cost. For example, pad printing or chromium plating may be omitted. In embodiments where carrier 120 is injection molded, carrier 120 includes the finished fiducial surface 134 as carrier 120 emerges from the injection molding tool. Controller 130 uses the determined position of carrier 120 to generate control signals, wherein carrier transport 22 (shown in FIG. 1) moves carrier 120 in response to such control signals, and wherein disc labeler 124 applies one or more labels to disc 12 in response to such control signals.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. A disc printing system comprising:

a disc carrier comprising:

a disc retaining portion;

a first surface spaced from the disc retaining portion at a predetermined location with respect to the disc retaining portion; and a recess adjacent the first surface; and a printer comprising:

a print head a sensor comprising:

a light emitter at a first angle offset from vertical; and an optical sensing element oriented at a second complementary angle offset from vertical; and a controller configured to determine a location of the carrier, based on first and second specular signals from the sensor as an area of incident light from the emitter is moved relative to and across the junction of the first surface and the recess, the first specular signal occurring when the area of the incident light is not received within the opening and impinges a first portion of the optical sensing element and the second specular signal occurring when the area of the incident light is received within the opening and impinges a second portion of the optical sensing element.

2. The system of claim 1, wherein the recess comprises an opening through the carrier.

3. The system of claim 1, wherein the printer further comprises a roller configured to engage the carrier to move the carrier and wherein the carrier further comprises a second surface raised with respect to the first surface and configured to elevate the roller above and over the first surface.

4. The system of claim 1, wherein the printer further comprises a roller configured to engage the carrier to move the carrier and wherein the carrier further comprises:

a first ramp on a first side of the first surface; and a second ramp on a second side of the first surface.

5. The system of claim 1, wherein the retaining portion comprises a footprint and wherein the footprint and the first surface are integrally formed as part of a single unitary body.

6. The system of claim 1, wherein the area of incident light emitted by the light emitter has a maximum dimension and wherein the recess is larger than the maximum dimension.

7. The system of claim 1, wherein the disc carrier extends within a plane and is configured to support a disc in the plane, wherein the light emitter and the optical sensing element extend along first and second axes, respectively, and wherein the first and second axes each extend oblique with respect to the plane.

8. An apparatus comprising:

a sensor comprising:

a light emitter configured to emit light at a first angle offset from vertical; and an optical sensing element oriented at a second complementary angle offset from vertical;

a disc carrier comprising:

a first disc retaining portion;

a reflective surface spaced from the first disc retaining portion by a predetermined distance; and an opening extending through the disc carrier adjacent to the reflective surface, wherein the reflective surface is configured to reflect an area of incident light from the light emitter and wherein the opening is larger than at least one dimension of the area of incident light impinging the carrier such that the opening is wider than a distance between two opposite boundary points of the area of the incident light such that an entirety of the area of incident light is receivable within the opening; and a controller configured to determine a location of the disc carrier as the area of the incident light is moved relative to and across the junction of the reflective surface and the opening based on first and second specular signals from the optical sensing element, the first specular signal occurring when the entirety of the area of incident light is not received within the opening and impinges a first portion of the optical sensing and the second specular signal occurring when the entirety of the area of incident light is received within the opening and impinges a second portion of the optical sensing element.

9. The apparatus of claim 1, wherein the reflective surface is integrally formed as part of a single unitary body with the disc carrier.

10. The apparatus of claim 1 further comprising at least one raised surface proximate the reflective surface.

11. The apparatus of claim 8 wherein the reflective area comprises a reflective portion extending proximate a perimeter of the disc retaining portion.

12. The apparatus of claim 1 further comprising:

a first ramp on a first side of the reflective surface; and a second ramp on a second opposite side of the reflective surface; and a roller configured to roll across and concurrently contact the first ramp and the second ramp.

13. The apparatus of claim 1, wherein the first disc retaining portion comprises a substantially circular footprint.

14. The apparatus of claim 1 further comprising a template providing a second disc retaining portion.

15. The apparatus of claim 14, wherein the first disc retaining portion comprises a first substantially circular footprint having a first diameter and wherein the second disc retaining portion has a second substantially circular footprint having a second distinct diameter.

16. The apparatus of claim 1 further comprising:

a printer comprising a print head.

17. The apparatus of claim 1, wherein the first retaining portion comprises a footprint recessed into a main surface and configured to receive a disc, wherein the reflective surface is elevated above the main surface, wherein the recess extends below the main surface and wherein the main surface and the reflective surface face in a same direction.

18. An apparatus comprising:

a disc carrier comprising:

a first disc retaining portion;

a reflective surface spaced from the first disc retaining portion by a predetermined distance; and an opening extending through the carrier adjacent to the reflective surface;

a first ramp on a first side of the reflective surface;

a second ramp on a second opposite side of the reflective surface; and a printer having a roller configured to engage the disc carrier to move the carrier, wherein the first ramp, the second ramp and the roller are configured such that the roller concurrently rolls across the first ramp and the second ramp over the reflective surface.

19. The apparatus of claim 18, wherein the first ramp and the second ramp span an entirety of the reflective surface.

* * * * *

UNITED STATES PATENT AND TRADEMARK OFFICE

CERTIFICATE OF CORRECTION

PATENT NO. : 8,057,115 B2
APPLICATION NO. : 11/494957
DATED : November 15, 2011
INVENTOR(S) : Stuart A. Scofield et al.

It is certified that error appears in the above-identified patent and that said Letters Patent is hereby corrected as shown below:

In column 8, line 65, in Claim 1, delete "head" and insert -- head; --, therefor.

In column 9, line 30, in Claim 6, delete "emitter" and insert -- emitter is configured to emit an area of light on the first surface --, therefor.

In column 9, line 52, in Claim 8, delete "area of" and insert -- area of the --, therefor.

In column 9, line 58, in Claim 8, delete "light" and insert -- light from the emitter --, therefor.

In column 10, line 6, in Claim 8, delete "sensing" and insert -- sensing element --, therefor.

In column 10, line 10, in Claim 9, delete "claim 1," and insert -- claim 8, --, therefor.

In column 10, line 13, in Claim 10, delete "claim 1" and insert -- claim 8 --, therefor.

In column 10, line 18, in Claim 12, delete "claim 1" and insert -- claim 8 --, therefor.

In column 10, line 24, in Claim 13, delete "claim 1," and insert -- claim 8, --, therefor.

In column 10, line 26, in Claim 14, delete "claim 1" and insert -- claim 8 --, therefor.

In column 10, line 33, in Claim 16, delete "claim 1" and insert -- claim 8 --, therefor.

In column 10, line 35, in Claim 17, delete "claim 1," and insert -- claim 8, --, therefor.

Signed and Sealed this
Sixteenth Day of October, 2012

David J. Kappos

David J. Kappos
*Director of the United States Patent and Trademark Office*